United States Patent [19]

Caron et al.

[11] Patent Number: 4,530,321

[45] Date of Patent: Jul. 23, 1985

[54] GLOW PLUG CONTROL CIRCUIT

[75] Inventors: LaVerne A. Caron, Naperville; Edward F. Handley, Clarendon Hills, both of Ill.

[73] Assignee: International Harvester Company, Chicago, Ill.

[21] Appl. No.: 570,064

[22] Filed: Jan. 12, 1984

[51] Int. Cl.[3] ..... F02N 17/00

[52] U.S. Cl. ..... 123/179 H; 123/179 B; 219/499

[58] Field of Search ..... 123/179 H, 179 B, 179 BG, 123/145 A; 219/499, 497, 515

[56] References Cited

U.S. PATENT DOCUMENTS

| | | | |
|---|---|---|---|
| 3,803,385 | 4/1974 | Sandorf | 219/499 |
| 3,866,587 | 2/1975 | Knapp | 219/499 |
| 3,955,067 | 5/1976 | Eldridge | 219/499 |
| 4,196,712 | 4/1980 | Kawamura et al. | 123/179 BG |
| 4,280,452 | 7/1981 | Kawamura et al. | 123/179 BG |
| 4,375,205 | 3/1983 | Green | 123/179 H |
| 4,377,138 | 3/1983 | Mitani et al. | 123/179 H |
| 4,391,237 | 7/1983 | Abe et al. | 123/179 H |
| 4,399,781 | 8/1983 | Tsukasaki | 123/179 H |
| 4,413,174 | 11/1983 | Ting | 219/511 |

FOREIGN PATENT DOCUMENTS

| | | | |
|---|---|---|---|
| 0005137 | 1/1979 | Japan | 123/179 H |
| 2024940 | 1/1980 | United Kingdom . | |

OTHER PUBLICATIONS

SAE Paper No. 790208, "Design of a Fast Start Glow Plug Control System for Diesel Engines" A. R. Sundeen, Feb. 1979.

*Primary Examiner*—Parshotam S. Lall

*Attorney, Agent, or Firm*—Dennis K. Sullivan; F. David AuBuchon

[57] ABSTRACT

The glow plug control circuit (28) is coupled by lead wire conductors to one or more glow plugs (31–38) for energizing same and includes a resistance bridge, the resistance (30) of the parallel connection of the one or more glow plugs plus the resistance (76) of the lead wire conductors being coupled to the bridge which has a first resistance leg, a second resistance leg, a third resistance leg (53), and a fourth resistance leg (54). A junction (128,130) between two resistance legs (56,53) is coupled to a source of voltage potential and a junction (67) between the other two resistance legs (53,54) being coupled to a common or ground (67). A comparator (72) having plus and minus inputs (70,74) and an output (82) is coupled to the bridge. One junction (58) between two of the resistance legs (53,54) connected between the voltage source and ground defines a reference voltage and is coupled to the minus input (74). One of the other resistance legs coupled between the voltage source and ground includes two series connector resistors (51,52) which define a voltage divider (41) and which are coupled to the glow plugs. The junction (60) between the resistors (51,52) is connected to the plus input (70) and has a voltage which is a percentage of the voltage across the glow plugs so that less than glow plug voltage is supplied to the comparator (72) and so that when the plugs (30) are heated to a set temperature, the voltage supplied from the divider (41) to the plus input (70) is equal to the voltage at said minus input.

49 Claims, 8 Drawing Figures

GLOW PLUG CONTROL CIRCUIT

FIELD OF THE INVENTION

The present invention relates to glow plug control circuits. More specifically, the present invention relates to a glow plug control circuit which provides for the rapid heating of a bank of parallel connected glow plugs to their set temperatures without overheating and for a subsequent temperature controlled intermittent "afterglow" energization of the glow plugs for an ambient-temperature-related time period.

DESCRIPTION OF THE PRIOR ART

Heretofore, various glow plug control circuits have been proposed for rapidly heating one or more "rapid warmup" glow plugs under controlled conditions to prevent overheating and damage to the glow plugs. One of the first such circuits was developed by the Automotive Products Division of Allied Chemical Corporation and is described in SAE Technical Paper No. 709208 by Arthur R. Sundeen and published Feb. 26, 1979. Such circuit utilizes a bimetal control element which allows for a rapid heating of the glow plugs to a set temperature followed by intermittent heating which can be represented by an undulating waveform as the bimetal element opens and closes electrical circuits as it heats and cools in an "afterglow" delayed energization period.

The controller utilized in the Allied Chemical Corporation control circuit utilizes a timer in which time is based on the characteristics of the bimetal element which serves as a "surrogate" for the glow plugs.

Examples of various glow plug control systems that use resistance bridges, comparators, control circuits and/or timer circuits are disclosed in the following patents:

| U.S. Pat. No. | PATENTEE |
|---|---|
| 4,196,712 | Kawamura et al |
| 4,280,452 | Kawamura et al |
| 4,375,205 | Green |
| 4,377,138 | Mitani et al |
| 4,399,781 | Tsukasaki |
| U.K. Patent Application No. 2 024 940 | Kawamura et al |

As will be described in greater detail hereinafter, the glow plug control circuit of the present invention differs from the previously proposed circuits by providing a compact, integrated control circuit unit which can be mounted directly on a diesel engine but which is not limited to engine mounting. The circuit is able to take advantage of positive temperature coefficient (PTC) glow plug characteristics automatically to control the temperature of a variety of such glow plugs thereby providing a glow plug heating system which is insensitive to system voltage or fluctations thereof and to ambient temperature. Heating and control thereof is achieved by utilizing a bridge circuit coupled to a comparator which, in conjunction with a low frequency oscillator clock, control the outputs of a bi-stable multivibrator which controls the energization of the glow plugs.

SUMMARY OF THE INVENTION

According to the present invention there is provided a method for controlling the rapid heating of one or more glow plugs which are energized by a power control circuit controlled by the output of a bi-stable multivibrator and an afterglow timer circuit and which are mounted in a diesel engine, comprising the steps of: causing the bi-stable multivibrator to output a logic high signal to cause the power control circuit to energize the plugs; comparing a voltage which is related to the resistnace of the one or more glow plugs and which is altered by the heating up of the glow plugs subsequent to their initial energization by the power control circuit against a reference voltage which is a fixed percentage of supply voltage and which corresponds to a predetermined set temperature of the one or more glow plugs; supplying a control signal to the bi-stable multivibrator when the voltage related to the temperature of the one or more glow plugs is equal to said reference voltage (1) to reset the output of the multivibrator to a logic low to de-energize the power control circuit and (2) to initiate a timing out of the afterglow timer circuit; supplying a clock signal to the multivibrator to cause the multivibrator to re-energize the power control circuit to re-energize the glow plugs; timing out said timer circuit for a predetermined time period related to the ambient temperature while control signals and clock signals are being generated intermittently to heat the glow plugs until the time period has expired; and de-energizing the multivibrator after said time period.

Also according to the present invention there is provided an apparatus for controlling the rapid heating of one or more glow plugs which are mounted in a diesel engine, said apparatus comprising a power control circuit for controlling energization of the glow plugs; a bi-stable multivibrator for controlling energization of said power control circuit; an afterglow timer circuit coupled to said multivibrator; means for causing said bi-stable multivibrator to output a logic high signal to cause said power control circuit to energize the plugs; means for comparing a voltage which is related to the resistance of the one or more glow plugs and which is altered by the heating up of the glow plugs subsequent to their initial energization by said power control circuit against a reference voltage which is a fixed percentage of supply voltage and which corresponds to a predetermined set temperature of the one or more glow plugs; means for supplying a control signal to said bi-stable multivibrator when the voltage related to the temperature of the one or more glow plugs is equal to said reference voltage (1) to reset an output of said multivibrator to a logic low to de-energize said power control circuit and (2) to initiate a timing out of said afterglow timer circuit; means for supplying a clock signal to said multivibrator to cause said multivibrator to re-energize said power control circuit to re-energize the glow plugs; means for timing out said timer circuit for a predetermined time period related to the ambient temperature while control signals and clock signals are being generated intermittently to heat the glow plugs until the time period has expired; and means for de-energizing said multivibrator after said time period.

Further, according to the present invention there is provided a glow plug control circuit coupled by lead wire conductors to one or more glow plugs for energizing same comprising: a resistance bridge, the resistance of the parallel connection of the one or more glow plugs plus the resistance of the lead wire conductors being coupled to and forming part of the bridge which has a first resistance leg, a second resistance leg, a third resistance leg, and a fourth resistance leg, the junction between two resistance legs being coupled to a source of voltage potential, the junction between the other two resistance legs being coupled to common or ground, a comparator having plus and minus inputs and an output, one junction of the bridge, between two of said resistance legs which are connected between the voltage source and ground, defining a reference voltage and being coupled to said minus input, one of the other resistance legs comprising two series connector resistors which are coupled across the glow plugs and which define a voltage divider in said other resistance leg, the junction between said resistors defining a voltage which is a percentage of the voltage across the glow plugs and being connected to said plus input so that less than glow plug voltage is supplied to said comparator and so that when the plugs are heated to a set temperature, the voltage supplied from the divider to said plus input is equal to the voltage at said minus input, an oscillator circuit for generating a clock signal at a fixed frequency, a power switching circuit coupled to the one or more glow plugs, and a bi-stable multivibrator having at least one reset input, at least one clock input, and at least one output, said output of said comparator being coupled to said at least one reset input, said at least one multivibrator output being coupled to said power switching circuit and the output of said oscillator circuit being coupled to said at least one clock input of said bi-stable multivibrator.

DESCRIPTION OF THE PREFERRED EMBODIMENT

Figure 1:
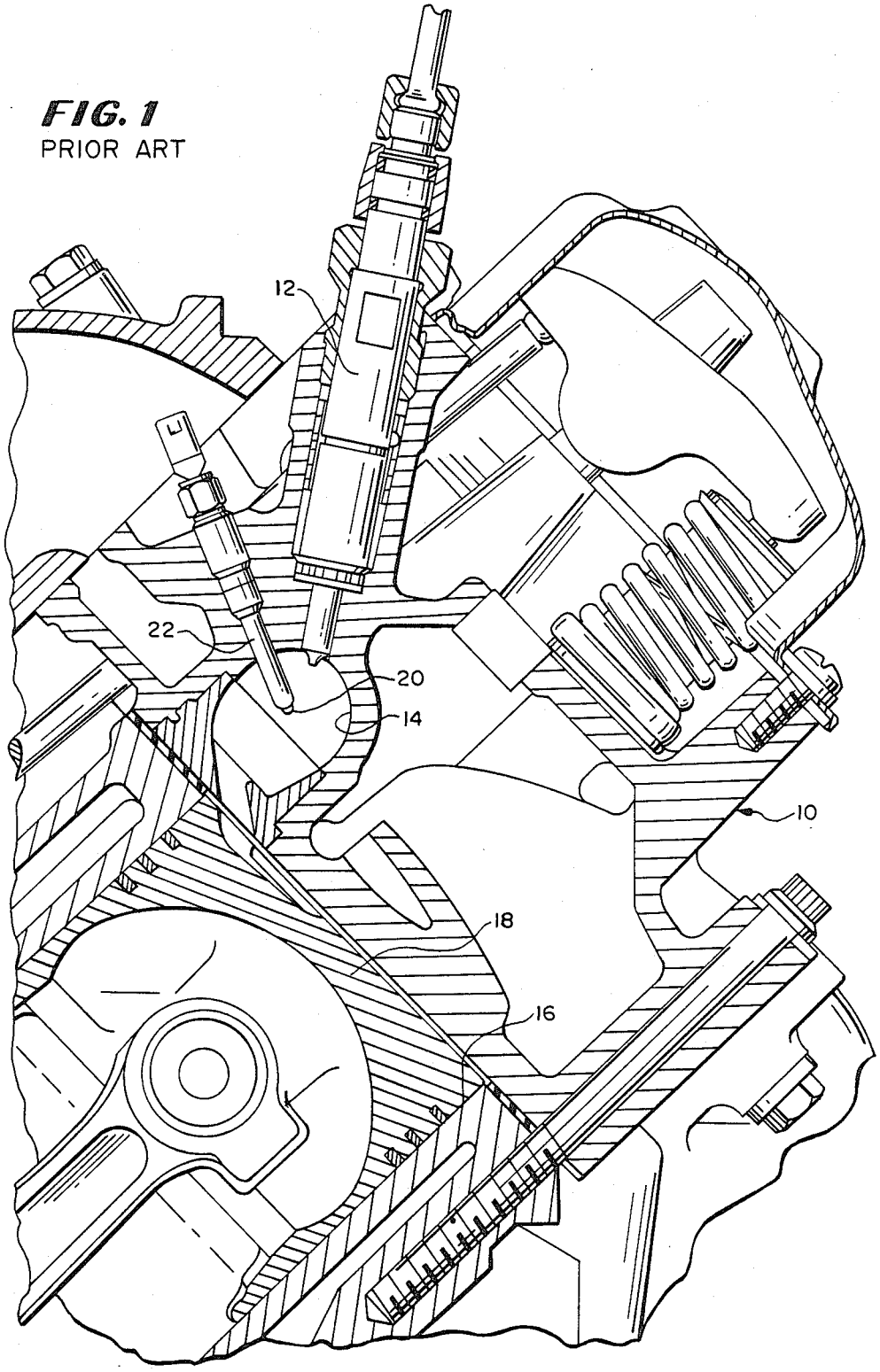
FIG. 1 PRIOR ART
FIG. 1 is a fragmentary sectional view of a prior art cylinder head of a diesel engine and shows a conventional glow plug mounted in a fuel receiving chamber just above and in communication with one cylinder of the engine.

Referring now to FIG. 1, there is illustrated therein a conventional prior art cylinder head 10 for a diesel engine having mounted therein a fuel injecting nozzle 12 for injecting fuel into a chamber 14 which is situated above and in communication with a cylinder 16 having a piston 18 therein. Also mounted in the chamber 14 is a tip 20 of a conventional glow plug 22. The diesel engine parts and their arrangement in FIG. 1 are conventional.

When the diesel engine is started, the glow plug tip 20 is heated to a predetermined temperature to cause combustion of diesel-air fuel mixtures in the cylinders.

It is desirable to heat the glow plug 22 as quickly as possible to the desired temperature without overheating the glow plugs and to maintain that temperature of the glow plugs 22 while the engine is warming up.

Figure 2:
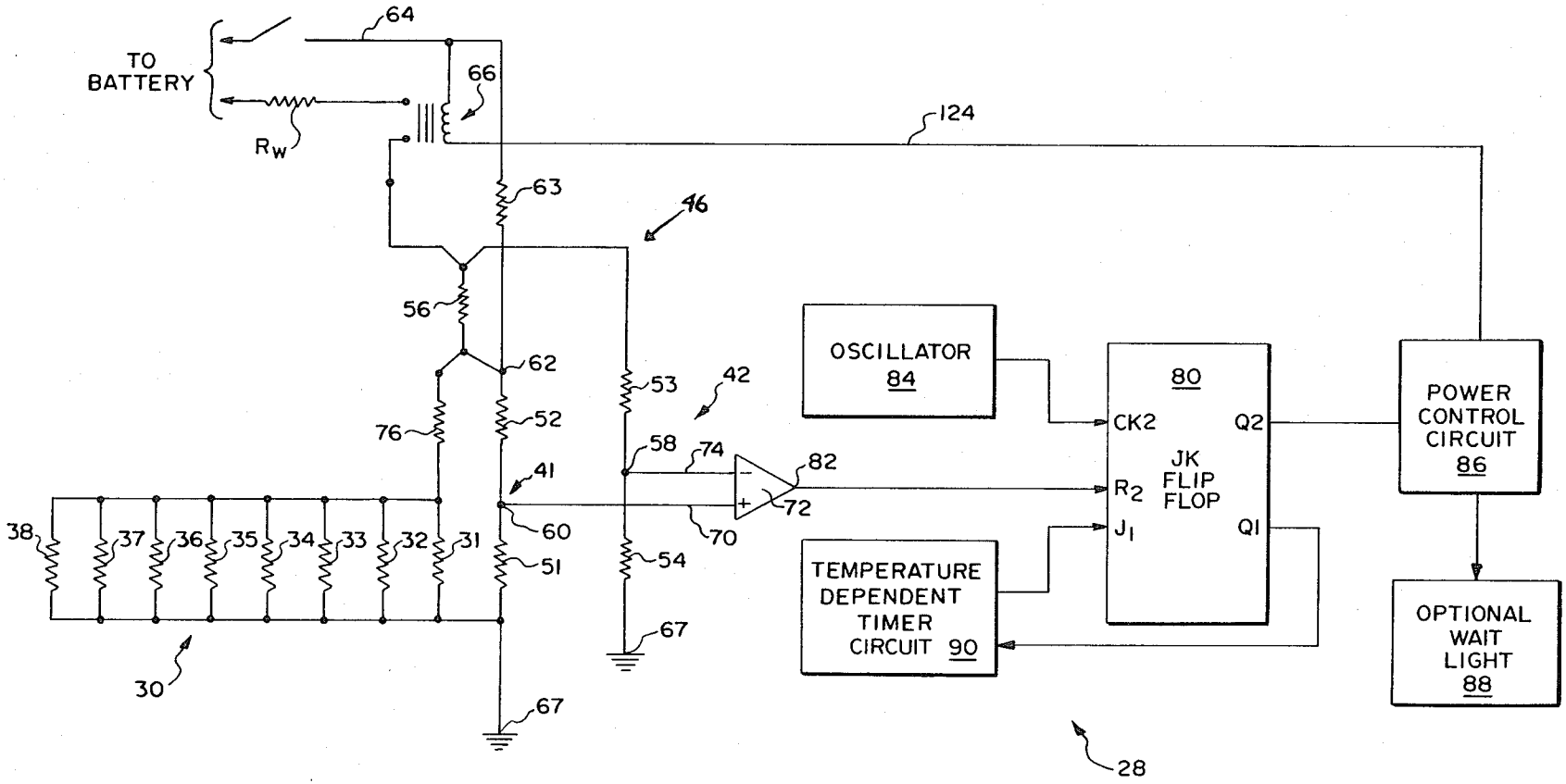
FIG. 2 is a block schematic circuit diagram of the glow plug control circuit of the present invention.

To achieve such heating of the glow plugs 22, a glow plug control circuit constructed according to the teachings of the present invention is coupled to the glow plugs 22 and is generally identified by reference numeral 28 in FIG. 2.

The block schematic circuit diagram shown in FIG. 2 of the glow plug control circuit 28 shows a bank 30 of eight glow plug resistances 31–38 connected in parallel. These eight resistances 31–38 represent Positive Temperature Coefficient (P.T.C.) glow plugs, the resistances of which will vary with temperature. Although eight resistances 31–38 are shown here, any number of glow plugs, dependent upon the number of cylinders, can be coupled to the glow plug control circuit 28. Also, the control circuit 28 is designed to control any P.T.C. glow plug but is especially useful for controlling very fast responding plugs (e.g. ceramic plugs) which can be easily damaged by crude timer based controllers.

As shown, the bank 30 of resistances 31–38 are coupled to a voltage/resistor divider 41. Another voltage/resistor divider 42 is coupled to the divider 41 for forming part of a bridge 46 and each divider 41,42 contains very precise resistance ratio resistors 51–54. A Kelvin contact resistor 56, forming part of the bridge 46, is connected between resistor 52 and the voltage source.

Voltage at a junction 58 between resistors 53 and 54 is compared with voltage at a junction 60 between resistors 51 and 52.

A junction 62 between resistors 52 and 53 is coupled by a safety resistor 63 (described in greater detail hereinafter) to a voltage bus 64 coupled to a power relay 66 for controlling the power (current) that is supplied to the bank 30 of resistances 31–38 for heating same as will be described in greater detail in connection with the description of FIG. 3. The other sides of the resistors 51 and 54 are coupled to system ground 67.

The bank 30 of glow plug resistances 31–38 is coupled across resistors 51 and 52 such that the voltage at the junction 60 is a percentage of the voltage across the glow plugs 22 and that lower voltage enables the circuit 28 to utilize a comparator which operates at a lower input voltage, e.g., around 5 volts, than the voltage, e.g., 10.5 volts, across the glow plugs 22. In this way the divider 41 effectively shifts the glow plug voltage down to the usable common mode input range of commercially available comparators.

When the equivalent resistance of the bank 30 of resistances 31–38 varies due to an increase in temperature, the voltage potential at junction 60 is varied. This junction 60 is coupled to a positive input 70 of a comparator 72. The other, negative or minus input 74 of the comparator 72 is coupled to the junction 58.

Also as described above, the safety resistor 63 is coupled between the junction 62 and the bus 64. The resistor 63 will "pull" the voltage at the junction 60 high if the connection between the bank 30 and junction 62 is open circuited.

Also, the resistance of the lead wire conductors is a lead harness (not shown) coupled between the glow plugs 22 and the power supply for the engine is represented by a resistance 76.

It is essential that the control circuit 28 be very insensitive to the supply voltage. This insensitivity is achieved with the connection of the circuit elements in the control circuit where:

$$Tgp = \delta + \epsilon\left[\frac{R_{56}A}{B - A} - R_W\right]$$

where:

Tgp is the temperature of the glow plugs;

$\delta$ and $\epsilon$ are characteristics of the plugs;

$R_W$ is the harness resistance between resistor $R_{56}$ and the glow plugs;

$$A = \frac{R_{54}}{R_{53} + R_{54}} \text{ and } B = \frac{R_{51}}{R_{51} + R_{52}}$$

Note: Tgp (the set temperature) is essentially independent of everything else such as ambient temperature and system voltage.

The glow plug control circuit 28 further includes a bi-stable multivibrator 80 which is preferably a JK flip flop. Here an output 82 from the comparator 72 is coupled to a reset input R2 of the multivibrator 80. At the same time an oscillator 84 supplies a clock signal to a clock input CK2 of the multivibrator 80.

An output Q2 from the flip flop 80 is coupled to a power control circuit 86 which in turn is coupled to the power relay 66 that controls the application of electric power to the bank 30 of the glow plug resistances 31–38.

An optional wait light circuit 88 is coupled to an output $\overline{Q}1$ from the multivibrator 80 and is energized while the glow plug control circuit 28 is supplying power to the glow plugs 22 to heat them to the desired temperature. Once the glow plugs 22 have reached a desired set temperature, the optional wait light (not shown) of the circuit 88 is de-energized.

A temperature dependent timer circuit 90 is also coupled to the multivibrator 80. An output Q1 of the multivibrator 80 is coupled to an input to the timer circuit 90 and an output from the timer circuit 90 is coupled to an input J2 of the multivibrator 80. The timer circuit 90 is cleared and set by the signal at output Q1 from the multivibrator 80 and then supplies a logic 1 signal to the input J2 which is output to the power control circuit 86 on the first clock signal from the oscillator 80 to the clock input CK2. This signal from output Q2 to the power control circuit 86 causes the circuit 86 to energize the power relay 66 to cause relay contacts thereof to close and energize the glow plugs 22. Then, when the voltage at junction 60 supplied to the plus input 70 of the comparator 72 exceeds the reference voltage at the minus input 74 of the comparator 72, a logic 0 signal at the output 82 of comparator 72 goes high to a logic 1 and this signal is supplied to the reset input R2 of the multivibrator 80 which will cause the output at output Q2 to the power control circuit 86 to go from a logic 1 to a logic 0 thereby de-energizing the power control circuit 86 and the power relay 66 until another clock signal from the oscillator 84 is received at the clock input CK2. This will cause the logic 1 signal at the input J2 to be output at Q2 connected to the power control circuit 86 to re-energize the power relay 66 to again supply power to the bank 30 of glow plug resistances 31–38.

The frequency of the clock signals from the oscillator 84 should be high enough so that deviations about the set temperature during the afterglow period are minimized but low enough to assure durability of the power relay 66. Typically, this range is between 0.1 and 10 Hz. Empirical experiments have shown that a preferred frequency is between 0.5 and 2 Hz. The exact frequency is not important.

As will be described in greater detail hereinafter, once a reset signal is received at input R2 of the multivibrator 80, an output signal of logic 1 generated at output Q1 is supplied to the timer circuit 90 to cause the circuit 90 to "time out". The timing out of the timer circuit 90 is determined by the ambient temperature at a thermistor 204 (FIG. 3) in the circuit 90 which causes a logic 1 signal at the input J2 to go to logic 0 after a time period dependent upon the ambient temperature. This is often referred to as an "afterglow" time during which electric power is still supplied intermittently to the bank 30 of glow plugs 22 to make certain that the gaseous mixture within the prechamber is heated to a sufficient temperature from the combustion occurring in the cylinder 16 to ensure positive engine run up and minimize white smoke output. Obviously, the colder the ambient temperature, the longer the timer circuit 90 will maintain a logic 1 signal at the input J2 of the multivibrator 80 to make certain that the engine is sufficiently heated for efficient (no white smoke) operation of the diesel engine.

Figure 3:
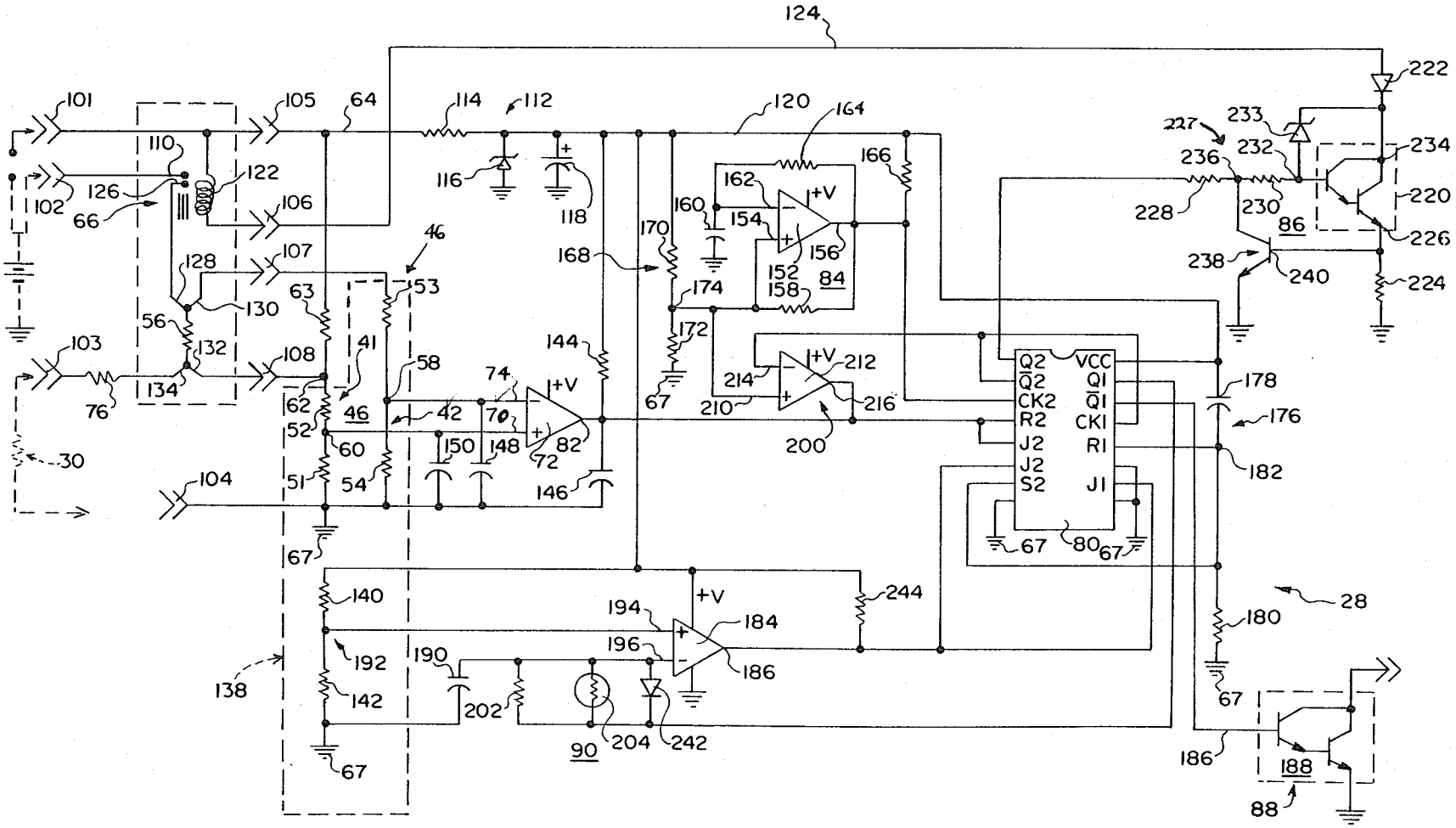
FIG. 3 is a detailed schematic circuit diagram of the glow plug control circuit shown in FIG. 2.

Referring now to FIG. 3 there is illustrated therein in greater detail, a complete schematic circuit diagram of the glow plug control circuit 28 of the present invention. First of all, a number of connect/disconnect connections 101–108 are shown. One connection 101 is a connection to the switched on battery. Another connection 102 is direct to the battery and supplies current to a relay contact 110 of the power relay 66. Another connection 103 is to the glow plugs 22 and the bank 30 of glow plug resistances 31–38. The connection 104 is to system ground 67. Here, lead conductor resistance 76 is shown coupled between connection 103 and a terminal 134.

The connections 101–108 can be plug and socket type connections or lug and bolt connections.

The switched on battery connection is also coupled through a connect/disconnect connection 105 to a voltage regulating and filter circuit 112 comprising a resistor 114, a Zener diode 116 and a capacitor 118 connected as shown. During normal operation, the input through connection 105 can be anywhere between 6 and 18 volts, and even up to 24 volts, and the regulated output voltage will be between 6 and 12 volts from the circuit 112 on a regulated bus 120.

Coil 122 of power relay 66 is connected from the unregulated bus 64 through connection 106 and a conductor 124 to the power control circuit 86.

Another relay contact 126 of the power relay 66 is connected to a contact 128 of resistor 56 and a sensing lead 130 of the resistor 56 is coupled through connection 107 to resistor 53.

Another connection 108 is between a sensing lead 132 of resistor 56 and the junction 62. The lead wire resistance 76 which is typically 1.17 milliohms is shown coupled between the glow plug resistances 31–38 and contact 134 of resistor 56.

Figure 5:
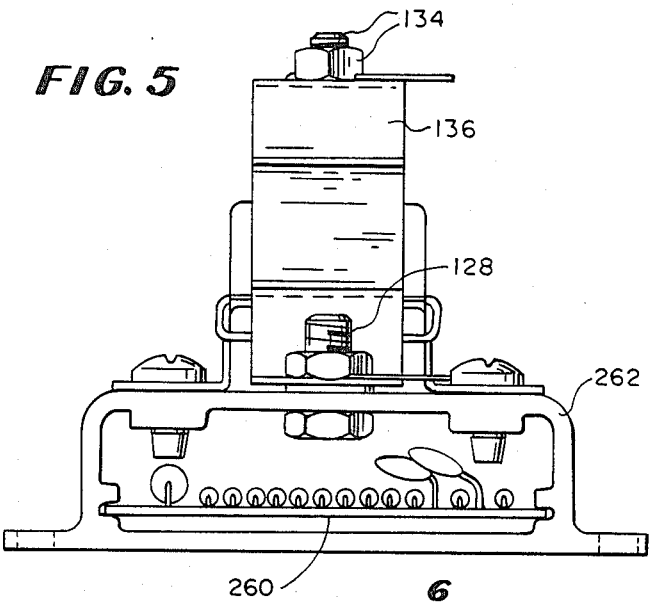
FIG. 5 is an end elevational view of the chassis shown in FIG. 4, is taken along line 5—5 of FIG. 4, and shows the printed circuit board with components mounted thereon in the chassis.
Figure 4:
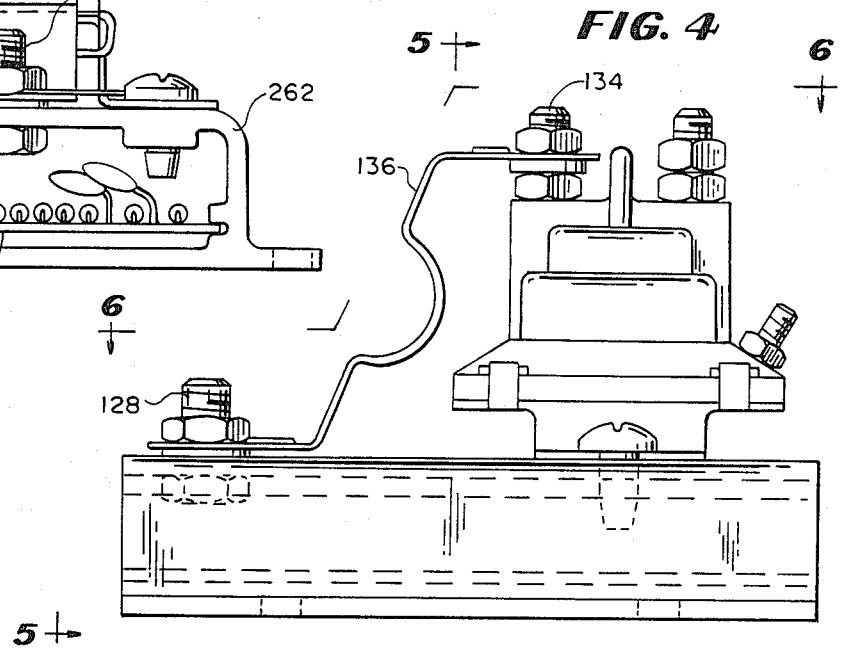
FIG. 4 is a side elevational view of the chassis for the printed circuit board of the glow plug control circuit and shows exterior components of the circuit.
Figure 6:
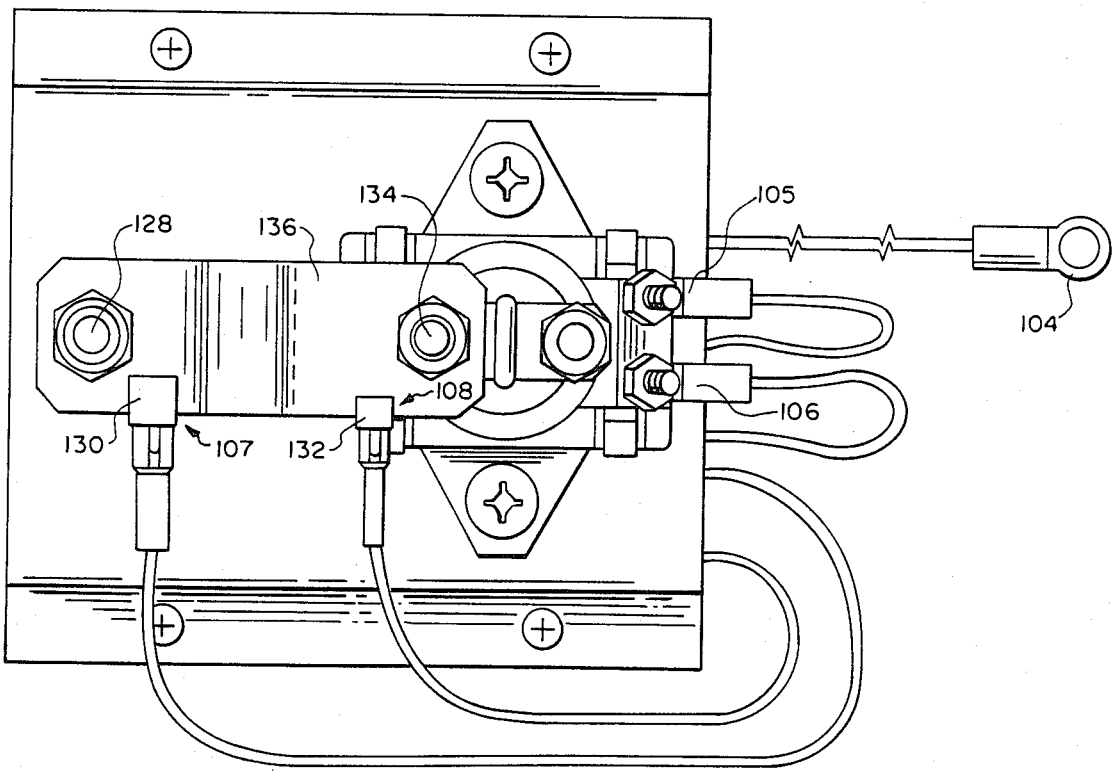
FIG. 6 is a top plan view of the chassis shown in FIG. 4, is taken along line 6—6 of FIG. 4 and shows lead connections from the printed circuit board to terminals on the chassis and to a low resistance bus bar for adjusting a low resistance value in the glow plug control circuit.

Resistor 56 is a four contact nickel-chrome alloy resistor which has a very low resistance of approximately 0.005 ohm and which is realized by a bus bar 136 (FIGS. 4, 5 and 6). Kelvin contacts 130 and 132 are welded in place such that the 0.005 ohms resistance appears between the contacts.

In practice, it may be desirable to adjust the upper contact, 130, prior to welding to effect an active trim of the control circuit 28. This would be done at the time of the module assembly. This is preferred since field adjustment is not recommended.

The resistor 56 is referred to as a four terminal Kelvin contact device. Such a resistor can be made very accurately to 0.005 ohms by adjustment of the two sensing leads 130 and 132. These leads measure a voltage drop across the metal bus or strip of metal 136. Typically, what takes place is that a reference current (e.g. 10 amps) is caused to flow through the metal strip 136 via power terminals 128 and 134 and the two sensing leads 130 and 132 are coupled to the strip at different points as shown in FIG. 6, and adjusted to a point where the voltage corresponding to the desired resistance is obtained. (E.g. for 0.005 ohm at 10 amps 50 MV will be read).

Typically, the resistance value of resistors 51, 52 and 54 is 3.3K ohm and of resistor 53 is 3.685K ohm.

The resistance ratios are critical, and to achieve accurate ratios very accurate resistors are used and are shown within a phantom box 138. These resistors include, not only the resistors 51–54, but also resistors 140 and 142 in the timer circuit 90 which will be described in greater detail hereinafter. Resistors having an accuracy of 1–2% will suffice. However, best results are obtained when the resistor accuracy for resistors 51–54, 140 and 142 is between 0.1 and 0.125%. The best method for controlling these ratios is to make use of thick or thin film networks.

It will be apparent from the portion of the glow plug control circuit 28 described so far, that if connection 108 were open circuited while the other connections were still intact, the glow plugs 22 would be overheated. To prevent this from happening, the safety resistor 63 brings up the voltage at the positive input 70 of the comparator 72 so that it appears to the comparator 72 that the resistances 31–34 of the glow plugs 22 has increased sufficiently to cause the comparator 72 to de-energize the power relay 66 so that the glow plugs 22 are not overheated. A typical value for resistor 63 is 180 ohm. This is much larger than the resistance of the parallel connected sense resistor 56 (approximately 0.005 ohm) so as to have a negligible effect on the control circuit 28 accuracy.

As shown, the voltages at junctions 60 and 58 are supplied to the positive and negative inputs 70,74 of comparator 72 which then has its output 82 coupled to the reset input R2 of the multivibrator 80.

Also as shown, a voltage pull up resistor 144 is connected between the regulated voltage bus 120 and the output 82 of the comparator 72 and a capacitor 146 is connected between the output 82 of the comparator 72 and system ground 67. Resistor 144 is required because the comparator 146 has an open collector output. The combination of resistor 144 and capacitor 146 form a low pass filter. The principle purpose of the low pass filter is to keep the comparator 146 from responding to extraneous noise generated by the mechanical relay contacts but will also prevent response to externally induced noise.

Capacitors 148 and 150 are coupled respectively to comparator inputs 70 and 74 for filtering out radio frequency noise.

The comparator output 82 is coupled to the reset input R2 of multivibrator 80 which also receives clock pulses generated by the oscillator 84 at the clock input CK2.

The oscillator 84 includes a comparator 152 having between its plus input 154 and output 156 a hysteresis resistor 158 which pulls the voltage input to the plus input 154 up or down dependent upon the charging of a capacitor 160 which is connected between ground 67 and minus input 162 of the comparator 152. This capacitor 160 is charged and discharged through a feedback resistor 164 connected between the output 156 and the input 162 of the comparator 152. Voltage is supplied through a coupling resistor 166 from the bus 120 to the output 156.

Also, a voltage divider 168 comprising resistors 170 and 172 is coupled between the bus 120 and ground 67 and a midpoint 174 thereof is coupled to the comparator input 154 to provide an initial bias voltage which is pulled up or down by the hysteresis resistor 158.

It is convenient to choose resistor 158=resistor 170=resistor 172. Then $f=0.721/RC_{160}$.

When a clock signal from the oscillator 84 is supplied to the clock input CK2 and the value of the signal to the reset input R2 is logic 0, the logic value at input J2 is clocked through multivibrator 80 to the output Q2.

To establish desirable initial conditions, an initializing circuit 176 comprising capacitor 178 and a resistor 180 are coupled between the bus 120 and ground 67 and the junction 182 therebetween is coupled to reset input R1 and set input S2 of the multivibrator 80.

It will be noted that the timer circuit 90 includes a comparator 184 which has its output 186 coupled to the inputs J2 and J1 of the multivibrator 80.

Briefly, the operation of the glow plug control circuit 28 and more particularly the multivibrator 80 is as follows.

When the power is turned on, the capacitor 178 initially acts as a short circuit and supplies a logic 1 input to the reset input R1. This reset forces Q1 to logic 0 and $\overline{Q1}$ to logic 1. The logic 1 at $\overline{Q1}$ is supplied to the base 186 of a Darlington transistor pair 188 of the wait light circuit 88 for energizing the optional wait light circuit 88. When the wait light (not shown) goes on, this tells the operator of the vehicle that the glow plug control circuit 28 is energized and that the operator should wait until the light goes off before starting the engine.

The initial logic 0 output from the output Q1 is supplied to a capacitor 190 in the timer circuit 90 via resistor 202 thereby to discharge any charge on the capacitor 190. In the meantime, a voltage from a voltage divider 192 comprising the resistors 140 and 142 connected between bus 120 and ground 67 is applied to input 194 of the comparator 184 in the timer circuit 90. The reference voltage at the + input is above the zero voltage at the negative input of the comparator input 196 so that initially there is a logic 1 output from the comparator 184 which is supplied to the inputs J2 and J1 of the multivibrator 80. The initializing circuit 176 also supplies a set signal to the input S2 which forces Q2 to a logic 1 thereby energizing the power control circuit 86 to energize the glow plugs 22. As a result the clock pulses being generated do not have an affect on the output Q2 until the voltage at input 70 goes above the voltage at input 74 at which time the output supplied to the reset input R2 goes from logic 0 to logic 1. This causes the output $\overline{Q2}$ to go to logic 1 and this logic 1 is fed to a reset input stabilizing circuit 200 which forces the input to reset R2 low again, which will be described in greater detail below, and also to the clock input CK1 which then clocks the logic 1 at input J1 to output Q1. This supplies a voltage through a resistor 202 and an NTC thermistor 204 to the capacitor 190 in the timer circuit 90 which then starts to charge. This starts the so-called "afterglow" time period and this occurs once the glow plugs 22 have reached their initial set temperature. Also the output Q2 is forced low to de-energize the relay 66 and the glow plugs 22 are now de-energized and begin to cool.

When the power relay contacts open both inputs to comparator 72 are essentially at ground potential. Thus output 82 is undefined. Circuit 200 overrides output 82 under these conditions ($\overline{Q2}$ high indicates relay is off) and ensures that reset R2 is held low so that oscillator 84 will be able to reactivate output Q2.

The oscillator is set at a sufficiently high frequency so that the plugs will be re-energized before a large amount of cooling occurs (e.g. 10° to 20° F.).

When the logic at reset input R2 returns back to logic 0, the logic 1 at the input J2 is clocked to the output Q2 at the next clock pulse for re-energizing the control circuit 86 and thereby the relay 66 to cause re-heating of the glow plugs 22.

In the meantime, however, the capacitor 190 is charging so that the intermittent on-off heating of the glow plugs 22 will last for a time (e.g. up to 90 seconds) sufficient to maintain the glow plugs 22 heated sufficiently for efficient operation of the diesel engine.

In other words, the glow plugs 22 will continue to be energized for a time period determined by the timer circuit 90 which is a time period sufficient to eliminate white smoke from the engine exhaust.

A plus voltage is supplied to a plus input 210 of a comparator 212 from the midpoint 174 of the voltage divider 168. At the same time, the logic at the output $\overline{Q2}$, which is initially a logic 0, is supplied to a negative input 214. Accordingly, the plus input 210 is greater than the negative input 214 whereby a logic 1 is at output 216 of comparator 212 and is pulled low by the logic 0 output of the comparator 72. Then, when the reset input R2 goes from logic 0 to 1 to change the output Q2 from logic 1 to logic 0, the output $\overline{Q2}$ goes from logic 0 to logic 1. This logic 1 output from output $\overline{Q2}$ is supplied, as described above, to the clock input CK1 to cause the logic 0 at output Q1 to go to logic 1 to start the timing circuit 90. At this time, this logic 1 goes to the negative input 214 which is higher than the voltage at input 210 driving output 210 to zero. This logic 0 then forces the reset input R2 back to zero so that the multivibrator 80 is ready for the next clock pulse or signal from the oscillator 84. Again, for proper operation of the circuit 28, the frequency of the clock pulses must be relatively low, i.e., between 0.1 and 10 Hz and typically between ½ and 2 Hz.

When the ambient temperature is very cold, such as 0° F. or lower, it will take a longer time for the capacitor 190 to charge up to a voltage equivalent to or higher than the voltage at input 194. This means that the glow plugs 22 will be energized intermittently by the oscillator circuit for an "afterglow" time period dependent upon ambient temperature after the set temperature has been reached. This timing period may reach 90 seconds when it is very cold.

On the other hand, when the temperature is very high, e.g. 100° F., the resistance of the thermistor 204 is very low and the capacitor 190 will charge very quickly so that the afterglow time is essentially zero time.

The timing circuit 90 also includes a voltage pull up resistor 244 coupled between the comparator output 186 and the voltage bus 120. The bus voltage is also supplied to the power supply input pin of the comparator 184 and to similar pins on all the other comparators 72,152 and 212.

Further, the timing circuit 90 includes a diode 242 connected as shown for effecting a quick discharge of capacitor 190 when output Q1 is at logic 0. This provides control circuit 28 reset so that a new control cycle can be initiated if the engine fails to start during the first cycle.

Referring now to FIGS. 4, 5 and 6, the control circuit 28 is mounted on a printed circuit board 260 received in a chassis or housing 262. This housing 262 is mounted at a convenient location on the vehicle and the bus bar or metal strip 136 is mounted on the housing 262.

In FIG. 6 the connections 104, 105 and 106 are shown as lug connectors to a pin, terminal or bolt and the connections 107 and 108 are shown as slidable clip connections of sensing leads 130 and 132 to bus bar 136.

Figure 7:
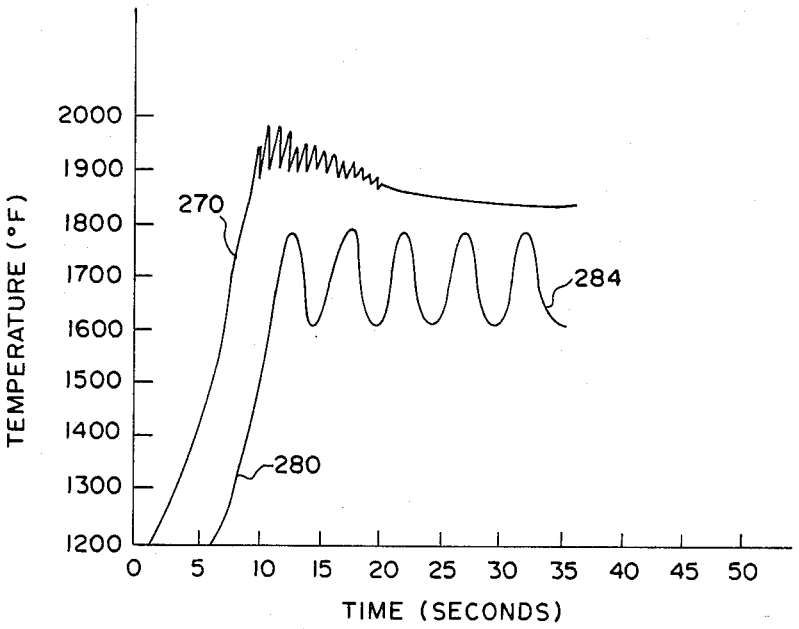
FIG. 7 is a graph of temperature vs time for the hot spot of a glow plug energized by a prior art circuit and of a glow plug energized by the glow plug control circuit of the present invention.

FIG. 7 shows a graph 270 of temperature vs time of a so-called "hot spot" on a glow plug tip 20. Zener 233 enables transistor 220 to suppress the inductive voltage kick which occurs when the relay coil 122 is deactivated. Otherwise, collector-emitter punch through could occur should the $V_{ceo}$ rating of transistor 220 be exceeded.

Referring now to the power control circuit 86, this circuit 86 includes Darlington transistor pair 220 having a high gain which is coupled to the one side of a relay coil 122 through a protecting diode 222 (which prevents any damage to the circuit 86 if the battery is connected with reverse polarity) and the conductor 124 and the connector 106. A current sensing resistor 224 is coupled between emitter 226 and ground 67.

The output Q2 is connected through a voltage divider circuit 227 made up of resistors 228 and 230 to a base 232 of the Darlington transistor pair 220. A Zener diode 233 is connected between a collector 234 and the base 232 as shown. Also, a junction 236 between the resistors 228 and 230 is coupled through a transistor 238 to ground 67 to provide current limiting at the power control circuit 86 if there is too much current flowing through resistor 224 which is coupled to base 240 of the transistor 238. In this respect, the voltage generated by a high current flowing through resistor 224 will turn on transistor 238 causing same to conduct and pull down the voltage at the base 232 of transistor pair 238 to turn the pair 220 off. Transistor 238 can only turn on to such a point that the voltage across resistor 224 is limited to $V_{be}$.

Returning now to the timer control circuit 90, as previously stated, the timer circuit 90 is initialized by initializing circuit 176 to discharge any charge on the capacitor 190 and to maintain a logic 1 at comparator output 186 to the inputs J2 and J1 of the multivibrator 80. Then, when a logic 1 timing signal is generated at the output Q1, the capacitor 190 starts to charge. This charging is controlled by the parallel connection of resistor 202 and NTC thermistor 204. The NTC thermistor 204 has an inverse temperature resistance characteristic such that the colder the temperature, the higher the resistance.

Initially, the capacitor 190 is pulled low through diode 242 which is connected to output Q1 which has a low output. Then when a reset signal comes into reset R2, such signal forces the output of $\overline{Q}2$ to go high and that signal goes into clock input CK1 and forces the output of Q1 to go high. With the output of Q1 high, the capacitor 190 starts to charge and charges until its voltage supplied to comparator input 196 exceeds the voltage at the input 194 which forces the voltage or signal level at the output 186 to go from a high to a low. This low is fed to input J2 and J1 and with the input at J2 low the flip flop 80 cannot clock through any more signals. At this time the engine should be running properly without producing white smoke.

As shown the timer circuit 90 also includes the voltage pull up resistor 244 connected between V+ and the output 186 of the comparator 184.

In FIG. 7 is shown a graph 270 of temperature vs time for glow plugs energized by the control circuit 28 of the present invention. Also shown is a graph 280 of temperature vs time of a "hot spot" on a glow plug tip 20 energized by a bimetal type control circuit such as the circuit developed by Allied Chemical Corporation. Heating time depends on the glow plug characteristic. The operating temperature may be chosen freely with either the Allied Chemical Corporation circuit or the control circuit 28 of the present invention.

Figure 8:
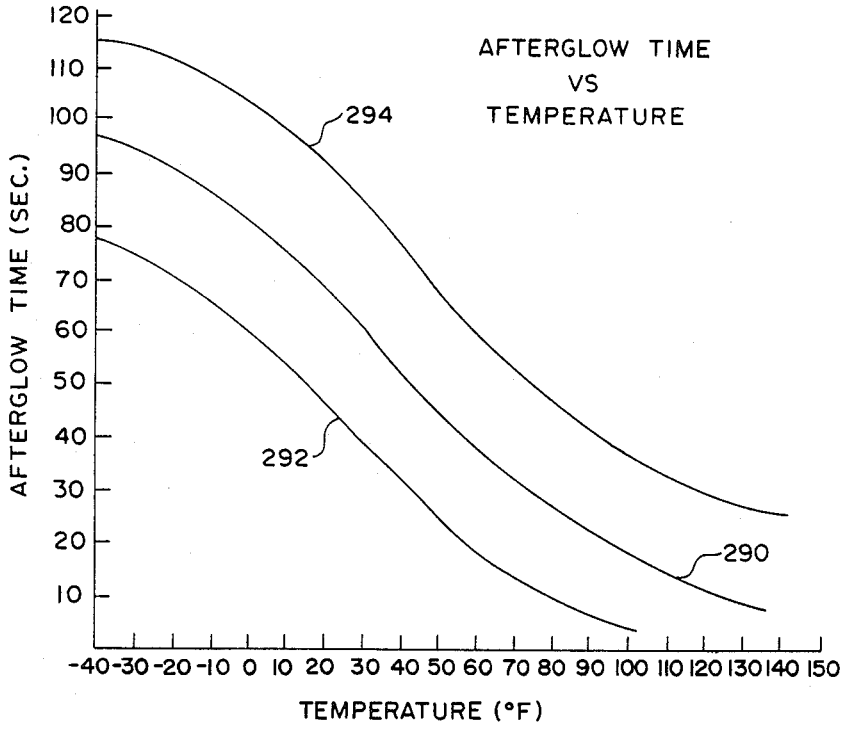
FIG. 8 is a graph of after glow time vs ambient temperature provided by the glow plug control circuit of the present invention where a capacitor in the circuit has a tolerance of ±20%.

In FIG. 8 is shown a graph 290 of the afterglow time vs ambient temperature. Also there is shown, upper and lower shifts 292 and 294 of this curve for a capacitor 190 having a ±20% accuracy.

From the foregoing description, it will be apparent that the glow plug control circuit of the present invention has a number of advantages some of which have been described above and others of which are inherent in the invention.

Two advantages are:

1. That the plug temperature will be held accurately during operation. (The Allied Chemical Corporation system cannot compensate for external heating and cooling of the plugs which occurs due to varying conditions in the pre-chamber); and 2. That wide excursions in temperature are eliminated during the control cycle.

More specifically, the control circuit 28, or simply controller 28, provides:

1. Circuitry for pulse width modulation (PWM) of a string of glow plugs wherein the modulation frequency may be chosen arbitrarily without affecting the operating set temperature of the glow plugs. This allows for an optimal choice of frequency, fast enough so that the plug sheath temperature is effectively constant but slow enough so that the power relay life does not suffer.

2. Construction of a bridge circuit in which a relatively high level voltage at the glow plug leg of the bridge may be conveniently shifted downward thus allowing the use of commonly available integrated circuit voltage comparators which have a limited common mode input range. This results in a controller which will operate accurately over a very wide range of supply voltages. (With proper choice of component values the system will work with both 12 and 24 volt systems interchangeably).

3. Simple circuitry including a JK flip flop for initiating time out of an afterglow timer at the point in time where the glow plugs reach the predetermined operating temperature and, if desired, for activating a wait lamp for the period of time between application of power to the controller and the time of reaching the plug operating temperature. The controller automatically compensates for variations between different types of plugs and for varying initial conditions. For example, if very rapidly heating (low thermal inertia) ceramic plugs are used, the wait period is automatically shortened to just that period needed to reach the set operating temperature.

Accordingly, the scope of the present invention is only to be limited as necessitated by the accompanying claims.

We claim:

1. A method for controlling the rapid heating of one or more glow plugs which are energized by a power control circuit controlled by the output of a bi-stable multivibrator and an afterglow timer circuit and which are mounted in a diesel engine, comprising the steps of: causing the bi-stable multivibrator to output a logic high signal to cause the power control circuit to energize the plugs; comparing a voltage which is related to the resistance of the one or more glow plugs and which is altered by the heating up of the glow plugs subsequent to their initial energization by the power control circuit against a reference voltage which is a fixed percentage of supply voltage and which corresponds to a predetermined set temperature of the one or more glow plugs; supplying a control signal to the bi-stable multivibrator when the voltage related to the temperature of the one or more glow plugs is equal to said reference voltage (1) to reset the output of the multivibrator to a logic low to de-energize the power control circuit and (2) to initiate a timing out of the afterglow timer circuit; supplying a clock signal to the multivibrator to cause the multivibrator to re-energize the power control circuit to re-energize the glow plugs; timing out said timer circuit for a predetermined time period related to the ambient temperature while control signals and clock signals are being generated intermittently to heat the glow plugs until the time period has expired; and de-energizing the multivibrator after said time period.

2. In a glow plug control circuit including a four leg bridge circuit for controlling the energization of a bank of glow plugs the improvement residing in that one of the legs of said bridge circuit includes two series connected resistors which form a voltage divider and in that a bank of glow plugs is connected across at least one of said resistors such that the voltage at a junction between said resistors is a percentage of the voltage across the glow plugs.

3. The glow plug control circuit of claim 2 further including a comparator having a minus input connected to a junction between two other of the four legs of said bridge circuit which two legs are series connected between a voltage source and ground or common for the circuit, and a plus input coupled to said junction between said resistors of said voltage divider in said one leg.

4. An apparatus for controlling the rapid heating of one or more glow plugs which are mounted in a diesel engine, said apparatus comprising a power control circuit for controlling energization of the glow plugs; a bi-stable multivibrator for controlling energization of said power control circuit; an afterglow timer circuit coupled to said multivibrator; means for causing said bi-stable multivibrator to output a logic high signal to cause said power control circuit to energize the plugs; means for comparing a voltage which is related to the resistance of the one or more glow plugs and which is altered by the heating up of the glow plugs subsequent to their initial energization by said power control circuit against a reference voltage which is a fixed percentage of supply voltage and which corresponds to a predetermined set temperature of the one or more glow plugs; means for supplying a control signal to said bi-stable multivibrator when the voltage related to the temperature of the one or more glow plugs is equal to said reference voltage (1) to reset an output of said multivibrator to a logic low to de-energize said power control circuit and (2) to initiate a timing out of said afterglow timer circuit; means for supplying a clock signal to said multivibrator to cause said multivibrator to re-energize said power control circuit to re-energize the glow plugs; means for timing out said timer circuit for a predetermined time period related to the ambient temperature while control signals and clock signals are being generated intermittently to heat the glow plugs until the time period has expired; and means for de-energizing said multivibrator after said time period.

5. The apparatus of claim 4 wherein said means for supplying a clock signal includes an oscillator.

6. The apparatus of claim 5 wherein said oscillator is designed to produce output pulses at a frequency between 0.1 and 10 Hz.

7. The apparatus of claim 6 wherein said frequency is between 0.5 and 2 Hz.

8. The apparatus of claim 4 wherein said means for comparing voltages and said means for supplying a control signal comprises a resistance bridge coupled to the one or more glow plugs and a comparator coupled to said resistance bridge.

9. The apparatus of claim 8 including a safety resistor coupled between said bridge and a voltage source.

10. The apparatus of claim 8 wherein one leg of said bridge includes a precise adjustable low resistance shunt resistor.

11. The apparatus of claim 8 wherein several of the resistors of said resistance bridge are accurate and precise to at least 2%.

12. The apparatus of claim 8 wherein several of the resistors of said resistance bridge are accurate and precise to at least 1%.

13. The apparatus of claim 8 wherein several of the resistors of said resistance bridge are accurate and precise to at least 0.25%.

14. The apparatus of claim 8 wherein several of the resistors of said resistance bridge are accurate and precise to at least 0.1%.

15. The apparatus of claim 8 wherein said bridge has four resistance legs and two legs include, respectively, first and second resistors which are coupled between the voltage source and ground with a junction between said resistors being coupled to a minus input of said comparator.

16. The apparatus of claim 8 wherein said bridge has four resistance legs and one of said legs has two series connected resistors therein defining a voltage divider, one or more of the glow plugs being connected across at least one of said resistors and the junction between said resistors being coupled to a plus input of said comparator whereby the voltage at said junction which is a percentage of the glow plug voltage is supplied to the comparator.

17. The apparatus of claim 8 including a control signal stabilizing circuit coupled between said multivibrator and an output of said comparator for holding the logic signals on said comparator output stable.

18. The apparatus of claim 4 wherein said bi-stable multivibrator is a J-K flip flop.

19. The apparatus of claim 4 wherein said power control circuit includes a Darlington transistor pair and current limiting means.

20. The apparatus of claim 19 wherein said power control circuit further includes a forward connected diode to prevent damage to the power control circuit if it is connected in the wrong polarity.

21. The apparatus of claim 19 wherein said power control circuit includes overcurrent shut-off means.

22. The apparatus of claim 4 including an initializing circuit coupled to said multivibrator for initializing said power control circuit and establishing desired logic values at inputs to and outputs from said multivibrator.

23. The apparatus of claim 22 wherein said timer circuit is coupled to said multivibrator and initialized by said initializing circuit.

24. The apparatus of claim 23 wherein said timer circuit comprises a comparator, means for establishing a reference voltage and supplying same to one input of said comparator, a capacitor coupled between an input of said comparator and system ground, and means coupled to said multivibrator for controlling charging of said capacitor when the one or more glow plugs reaches a set temperature.

25. The apparatus of claim 24 wherein said controlling means comprises a logic output from said multivibrator which is clocked from a "low" to a "high" to start charging of said capacitor when the one or more glow plugs reaches a set temperature.

26. The apparatus of claim 24 wherein said controlling means include a thermistor having a resistance value inversely related to the ambient temperature and being series coupled with said capacitor to control the timing out time period.

27. The apparatus of claim 4 including a wait light circuit coupled to said multivibrator and energized by same for energizing a lamp while the apparatus is heating the one or more glow plugs.

28. A glow plug control circuit coupled by lead wire conductors to one or more glow plugs for energizing same comprising: a resistance bridge, the resistance of the parallel connection of the one or more glow plugs plus the resistance of the lead wire conductors being coupled to and forming part of the bridge which has a first resistance leg, a second resistance leg, a third resistance leg, and a fourth resistance leg, the junction between two resistance legs being coupled to a source of voltage potential, the junction between the other two resistance legs being coupled to common or ground, a comparator having plus and minus inputs and an output, one junction of the bridge, between two of said resistance legs which are connected between the voltage source and ground, defining a reference voltage and being coupled to said minus input, one of the other resistance legs comprising two series connector resistors which are coupled across the glow plugs and which define a voltage divider in said other resistance leg, the junction between said resistors defining a voltage which is a percentage of the voltage across the glow plugs and being connected to said plus input so that less than glow plug voltage is supplied to said comparator and so that when the plugs are heated to a set temperature, the voltage supplied from the divider to said plus input is equal to the voltage at said minus input, an oscillator circuit for generating a clock signal at a fixed frequency, a power switching circuit coupled to the one or more glow plugs, and a bi-stable multivibrator having at least one reset input, at least one clock input, and at least one output, said output of said comparator being coupled to said at least one reset input, said at least one multivibrator output being coupled to said power switching circuit and the output of said oscillator circuit being coupled to said at least one clock input of said bi-stable multivibrator.

29. The glow plug control circuit of claim 28 including a safety resistor coupled between said voltage source and said bridge.

30. The glow plug control circuit of claim 28 wherein said resistance legs have resistors therein accurate and precise to at least 2%.

31. The glow plug control circuit of claim 28 wherein said resistance legs have resistors therein accurate and precise to at least 1%.

32. The glow plug control circuit of claim 28 wherein said resistance legs have resistors therein accurate and precise to at least 0.25%.

33. The glow plug control circuit of claim 28 wherein said resistance legs have resistors therein accurate and precise to at least 0.1%.

34. The glow plug control circuit of claim 28 wherein said power switching circuit includes a Darlington transistor pair and a relay having a relay coil coupled to said Darlington transistor pair and having relay contacts series connected with the one or more glow plugs.

35. The glow plug control circuit of claim 34 wherein said power switching circuit includes current limiting means, current shut-off means and a protective diode for protecting against wrong polarity connections.

36. The glow plug control circuit of claim 28 including a wait light circuit coupled to said multivibrator and being energized when said glow plug control circuit is heating the one or more glow plugs.

37. The glow plug control circuit of claim 28 including a reset input stabilizing circuit coupled between said multivibrator and said comparator output.

38. The glow plug control circuit of claim 37 wherein said reset input stabilizer circuit includes a comparator having an output coupled to said reset input of said multivibrator, one input coupled to a reference voltage and another input coupled to an output of said multivibrator.

39. The glow plug control circuit of claim 28 including a timer circuit coupled to inputs of said multivibrator.

40. The glow plug control circuit of claim 39 including an initializing circuit coupled to said multivibrator for initializing said power switching circuit and establishing desired logic values to inputs and at outputs of said multivibrator.

41. The glow plug control circuit of claim 40 wherein said initializing circuit includes a capacitor and resistor series connected between the voltage source and ground with the junction between them coupled to inputs of said multivibrator.

42. The glow plug control circuit of claim 40 wherein said timer circuit includes a comparator having one input coupled to a reference voltage, a capacitor coupled between another input of said capacitor and system ground, an output of said comparator being coupled to said multivibrator, and means for controlling charging of said capacitor.

43. The glow plug control circuit of claim 42 wherein said control means comprise an output of said multivibrator which is coupled to said capacitor and which is clocked from a "low" to a "high" when the one or more glow plugs reach a set temperature.

44. The glow plug control circuit of claim 43 wherein said controlling means comprise a thermistor series connected with said capacitor and having a resistance which varies inversely with the ambient temperature such that the timing period of said timer circuit is inversely related to the ambient temperature.

45. The glow plug control circuit of claim 28 wherein one of said resistance legs includes a low resistance shunt resistor.

46. The glow plug control circuit of claim 45 wherein said shunt resistor is a four contact Kelvin device.

47. The glow plug control circuit of claim 45 wherein said shunt resistor is realized by a metal strip having end terminals for coupling to the voltage source and adjustable sensing clip contacts on said strip for precisely establishing said low resistance.

48. The glow plug control circuit of claim 28 wherein said oscillator is designed to produce output pulses at a frequency of between 0.1 and 10 Hz.

49. The glow plug control circuit of claim 48 wherein said frequency is between 0.5 and 2 Hz.

* * * * *